US007261248B2

(12) United States Patent
Curtis

(10) Patent No.: US 7,261,248 B2
(45) **Date of Patent: *Aug. 28, 2007**

(54) SPRAY NOZZLE

(76) Inventor: Harold D. Curtis, 2804 SW. 130th, Oklahoma City, OK (US) 73170

( * ) Notice: Subject to any disclaimer, the term of this patent is extended or adjusted under 35 U.S.C. 154(b) by 0 days.

This patent is subject to a terminal disclaimer.

(21) Appl. No.: 11/223,583

(22) Filed: Sep. 9, 2005

(65) Prior Publication Data

US 2006/0038046 A1 Feb. 23, 2006

Related U.S. Application Data

(63) Continuation-in-part of application No. 10/937,462, filed on Sep. 9, 2004.

(51) Int. Cl.
*B02B 1/00* (2006.01)
*B02C 13/00* (2006.01)
*B05B 1/26* (2006.01)

(52) U.S. Cl. ..... 241/38; 241/185.6; 239/498; 239/523; 239/383

(58) Field of Classification Search ..... 241/38, 241/166, 167, 291, 2, 185.6, 46.01; 293/498, 293/499, 502, 523, 383, 382, 459
See application file for complete search history.

(56) References Cited

U.S. PATENT DOCUMENTS 2,555,271 A 5/1951 Jauch et al.
4,081,138 A 3/1978 Behr
4,337,216 A 6/1982 Korsell
5,569,415 A 10/1996 Phelps
5,833,143 A 11/1998 Hsin-Fa
5,839,667 A 11/1998 Fishcer
6,070,860 A 6/2000 Kinney, Jr. et al.
6,164,566 A * 12/2000 Hui-Chen ..... 239/394
6,598,810 B2 * 7/2003 Lanteri ..... 239/452
6,675,581 B1 1/2004 Stuttaford et al.
6,715,699 B1 * 4/2004 Greenberg et al. ..... 239/394
6,905,082 B1 * 6/2005 Wu ..... 239/436
6,991,192 B2 * 1/2006 Phillips et al. ..... 241/46.01
2003/0145619 A1 8/2003 Word
2004/0080060 A1 4/2004 Mockery et al.
2004/0195359 A1 10/2004 Curtis

* cited by examiner

*Primary Examiner*—Faye Francis
(74) *Attorney, Agent, or Firm*—Dunlap Codding & Rogers

(57) ABSTRACT

A spray nozzle that includes a nozzle body defining a first surface, a cap defining a second surface able to define an annular nozzle opening therebetween, and a turbine having a plurality of radially extending fins circumferentially positioned about the nozzle opening for directing the flow of fluid exiting the nozzle opening. The turbine is rotatably connected to the cap such that the nozzle opening is free of any portion of the turbine. The spray nozzle further includes a grinding member.

32 Claims, 11 Drawing Sheets

SPRAY NOZZLE

CROSS-REFERENCE TO RELATED APPLICATIONS

This application is a continuation-in-part of U.S. Ser. No. 10/937,462, filed Sep. 9, 2004, which claims benefit of U.S. Provisional application Ser. No. 10/451,333, filed Feb. 3, 2004, the content of each is hereby incorporated herein by reference.

BACKGROUND OF THE INVENTION

1. Field of the Invention

The present invention relates generally to a spray nozzle, and more particularly, but not by way of limitation, to an improved spray nozzle that is constructed to remain substantially clog free and an improved method of using a spray nozzle to zone water loading within the cooling tower and thereby balance the air to water mixture of the cooling tower.

2. Brief Description of Related Art

Cooling towers typically utilize a grid work of overhead nozzles to form a plurality of overlapping spray patterns for the purpose of distributing water over the upper surface of a layer of fill material through which air is drawn. The water flows downward through the fill material as the air flows upward through or across the fill material whereby the heat of the water is transferred to the air.

It is important to obtain as uniform a distribution as possible of the water over the upper surface of the fill material so that the water will uniformly flow through the fill material across the entire cross-sectional area of the tower. If the water distribution is not uniform, channels of uneven water loading will develop which cause the formation of low pressure paths through which the air will channel, thus greatly reducing the efficiency of the heat exchange operation conducted by the cooling tower.

It has been found that the efficiency of the heat exchange operation is greatly increased by using fluid distributing devices or nozzles that will create a plurality of abutting or overlapping square spray patterns, such as that disclosed in U.S. Pat. No. 5,152,458, the entire contents of which are hereby incorporated herein by reference. The formation of square spray patterns enables the spray patterns to be mated with each other so that voids or gaps do not exist between adjacent spray patterns. However, inefficiencies may still occur if the fluid distributed by each nozzle is not distributed uniformly across each of the individual square spray patterns.

The nozzles typically include a nozzle body, a cap, and a turbine. The nozzle body is provided with a central hub fixed within a fluid passage of the nozzle body with a plurality of radially spaced ribs. The cap has a stem with a central bore. The stem is configured to be slidingly registered in the central hub of the nozzle body. The cap is connected to the nozzle body so that the nozzle body and the cap are spaced apart from one another to define an annular nozzle opening therebetween.

The turbine has a mounting ring sized to be positioned about the nozzle body, a plurality of fins extending circumferentially about a bottom surface of the nozzle body, and a plurality of guide tabs extending radially inwardly of the mounting ring for maintaining the fins in an operable relationship with the nozzle opening. The fins extend radially outward from the bottom surface of the mounting ring so that the fins are positioned to intercept the fluid exiting the nozzle opening and uniformly distribute the water. The guide tabs are sized and shaped to be positioned in the nozzle opening so that the turbine is freely rotatable between the nozzle body and the cap. The guide tabs are generally flat so that a portion of the fluid in the nozzle opening flows across the top of the guide tab while another portion of the fluid flows across the bottom side of the guide tab. The flow of fluid across the guide tabs in this manner creates a fluid bearing on which the guide tabs and in turn the turbine rotate.

While such nozzles have met with success, drawbacks nevertheless are encountered. In particular, such cooling tower nozzles are subject to failure as a result of debris clogging the nozzle and solids accumulating on the guide tabs. Cooling tower water often contains debris, such as twigs and plastic bags, and solid particulate matter. The debris will often catch on the central hub of the nozzle body and/or the radial ribs that support the central hub, thereby clogging the nozzle. In addition, sludge can build up on the guide tabs thereby increasing the weight of the turbine and thus increasing the friction between the guide tabs and the cap which in turn results in premature failure of the guide tabs.

To this end, a need exists for a spray nozzle which overcomes the problems of the prior art. It is to such a spray nozzle that the present invention is directed.

DETAILED DESCRIPTION OF THE INVENTION

Figure 1:
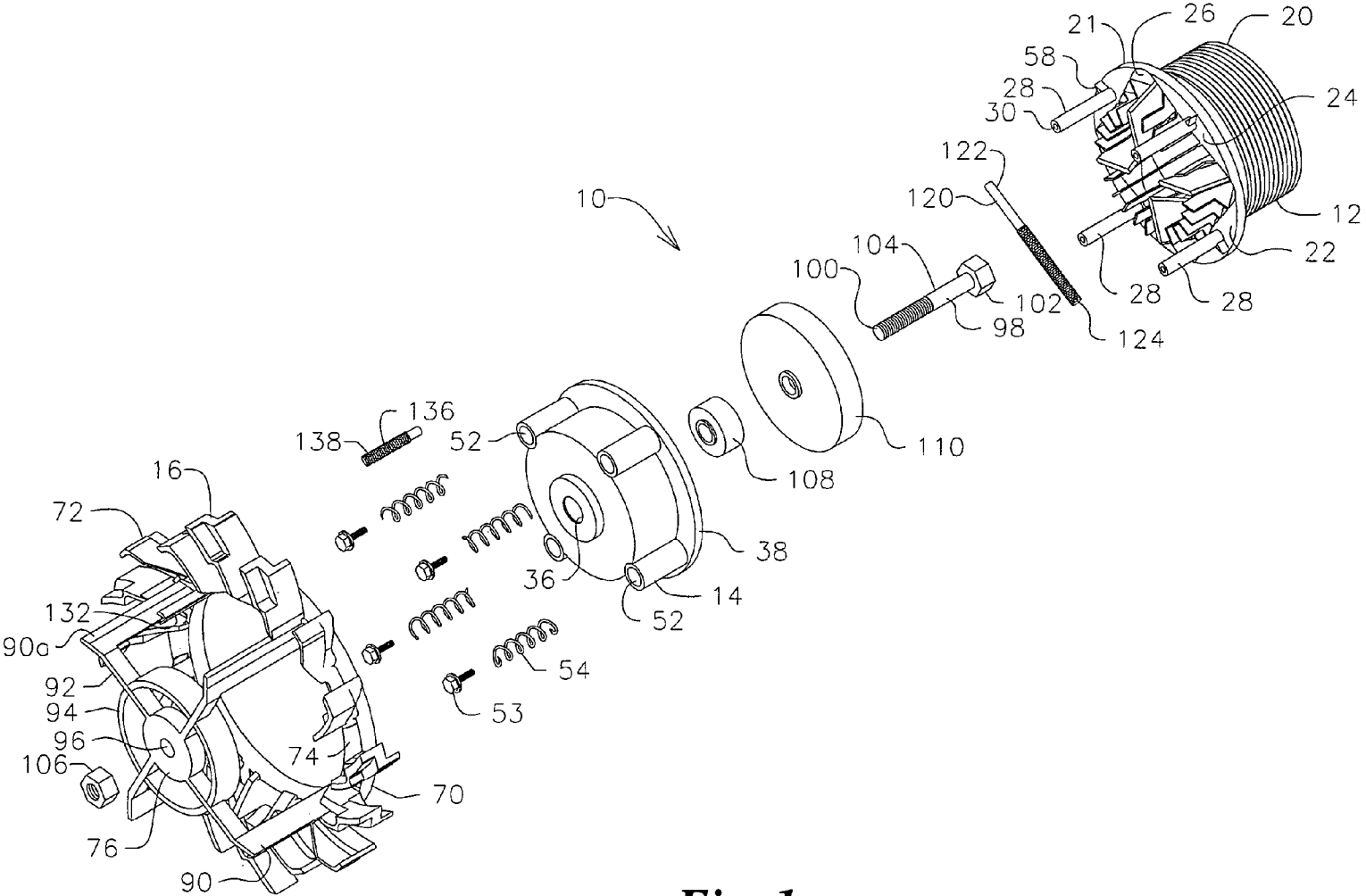
FIG. 1 is an exploded, perspective view of a spray nozzle constructed in accordance with the present invention.
Figure 2:
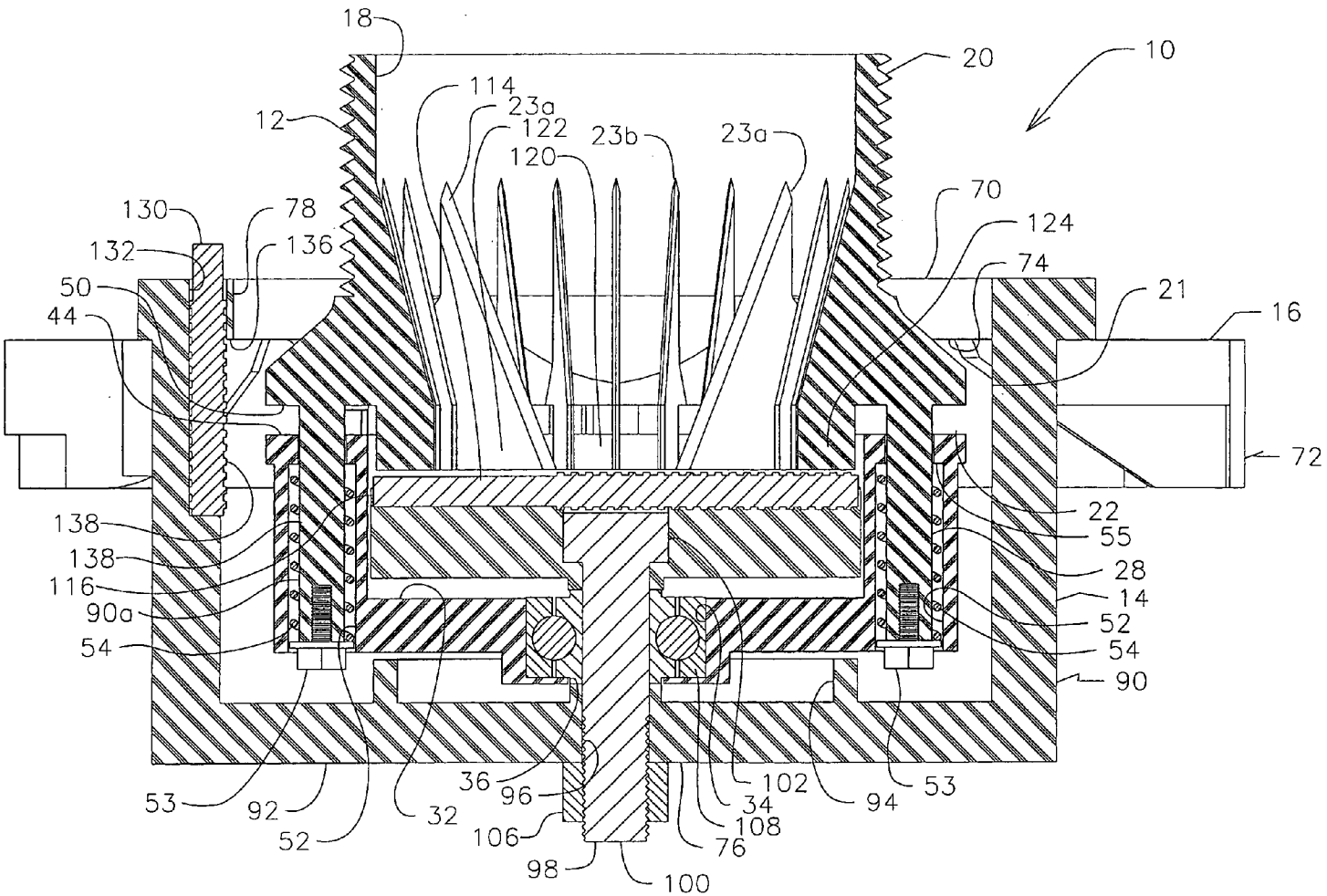
FIG. 2 is a sectional view of a spray nozzle of the present invention.

Referring now to the drawings, and more particularly to FIGS. 1 and 2, shown therein is a spray nozzle 10 constructed in accordance with the present invention. The spray nozzle 10 includes a nozzle body 12, a cap 14, and a turbine 16.

The nozzle body 12 is a generally tubular member defining a fluid passage 18 (FIG. 2). The nozzle body 12 has a threaded inlet end 20 for connecting the nozzle body 12 to a fluid distributing header (not shown) and an outlet end 21 provided with an irregular shaped annular surface 22.

Figure 3:
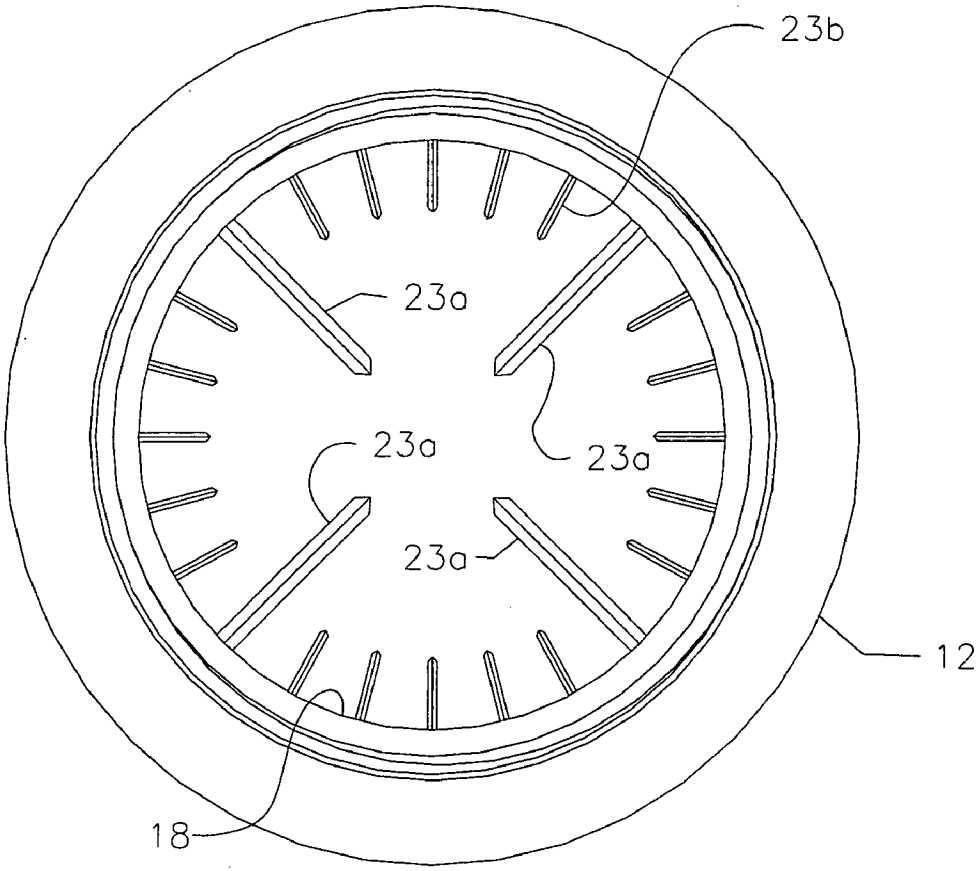
FIG. 3 is a top plan view of a nozzle body.

To contain and direct debris contained in the flow of fluid along a generally central path through the fluid passage 18 and to prevent vortical fluid flow, the nozzle body 12 is provided with a plurality of fins circumferentially spaced and extending radially into the fluid passage of the nozzle body 12. As best shown in FIGS. 2 and 3, the nozzle body 12 is provided with a plurality of primary fins 23*a* and a plurality of secondary fins 23*b*. The primary fins 23*a* are generally wider than the secondary fins 23*b* and thus extend further into the fluid passage 18. In the embodiment shown in FIGS. 2 and 3, the nozzle body 12 is provided with four primary fins 23*a* which are equally spaced about the interior surface of the nozzle body 12. Each of the primary fins 23*a* tapers from the outlet end 21 toward the inlet end 20 of the nozzle body 12 and extends beyond the annular surface 22 of the nozzle body 12.

The secondary fins 23*b* are equally spaced between the primary fins 23*a*. In the embodiment shown herein, five secondary fins 23*b* are shown to be formed between each of the primary fins 23*a*. However, it will be appreciated that the number of secondary fins 23*b* used may be varied. Like the primary fins 23*a*, the secondary fins 23*b* taper from the outlet end 21 toward the inlet end 20 of the nozzle body 12 and extend beyond the annular surface 22 of the nozzle body 12.

The irregular shaped annular surface 22 is an undulating surface having four peaks 24 equally spaced at 90 degree intervals about the circumference of annular surface 22 and four troughs 26 located between the peaks 24 and also being substantially equally spaced. One of the troughs 26 is located equidistant between each adjacent pair of peaks 24.

The nozzle body 12 is further provided with a plurality of guide posts 28 extending downwardly from the peaks 24 of the annular surface 22. Each guide post 28 has a threaded opening 30 (FIG. 1) formed in the distal end thereof. While four guide posts 28 are shown, it should be understood that the number of guide posts 28 may be varied so long as the spray nozzle 10 functions in the manner to be described below.

The cap 14 is a generally cylindrically shaped, closed ended member defining a cavity 32 (FIG. 2). The cap 14 is provided with a central counterbore 34 and an opening 36 which is in communication with the counterbore 34. The cap 14 has a rim 38 that defines an annular surface 44 which has a substantially planar configuration. The cap 14 is connected to the nozzle body 12 so that the annular surface 22 of the nozzle body 12 and the annular surface 44 of the cap 14 are spaced apart from one another to define a substantially annular nozzle opening 50 therebetween. Because of the irregular shape of the surface 22, the spacing between the surface 22 and the surface 44 varies around a circumference of the annular nozzle opening 50 to create a non-circular spray pattern of fluid exiting the nozzle opening 50. In particular, a generally square spray pattern will be provided due to the formation of four troughs 26 and four peaks 24. The fluid flowing past the peaks 24 will define the corners of the square pattern because the peaks 24 cause a flow restriction which increases the pressure of the fluid and thus causes the fluid to flow farther than the fluid flowing past the troughs 26.

To connect the cap 14 to the nozzle body 12, the cap 14 is provided with a plurality of holes 52 spaced about the periphery of the cap 14 and sized to slidably receive the guide posts 28 of the nozzle body 12. The cap 14 is connected to the nozzle body 12 with a plurality of fasteners 53, such as bolts, and a plurality of compression springs 54. The compression springs 54 are positioned in the holes 52 and about the guide posts 28 of the nozzle body 12 and engaged with an annular shoulder 55. The fasteners 53 are then secured to the opening 30 of the guide posts 28. Each of the fasteners 53 has a head that supports the corresponding end of the compression spring 54.

The slidable mounting of the cap 14 on the nozzle body 12 in combination with the use of the compression springs 54 provides an automatic adjusting mechanism for increasing the spacing between the first and second annular surfaces 22 and 44 in response to an increase in fluid pressure in the annular nozzle opening 50.

The cap 14 is shown in FIG. 2 in an initial position wherein a minimum spacing between the annular surfaces 22 and 44 is defined by a stop member 58 (FIG. 1) formed adjacent the proximal end of each of the guide posts 28 of the nozzle body 12. It should be noted that to better illustrate the annular nozzle opening 50, the stop members 58 have been omitted from the nozzle body 12 in FIG. 2. When fluid pressure supplied to the spray nozzle 10 is increased, the increased downward force acting on the cap 14 will compress the springs 54 to increase the spacing between annular surfaces 22 and 44. As an example, the spray nozzle 10 will be designed with an initial minimum clearance between surfaces 22 and 24 at the peaks 24 of one-quarter inch. The springs 54 will be chosen to allow a stroke of about one-half inch so that the maximum clearance between surfaces 22 and 44 will be about three-quarters inch.

It will be appreciated that in the absence of the automatic nozzle adjustment provided by the spring 54 and the sliding engagement of cap 14 with the guide posts 28, a substantial increase in fluid supply pressure would cause the spray pattern to be extended radially outward to an undue extent and would tend to create a void in the center of the pattern. Conversely, a decrease in flow supply pressure would cause the spray pattern to be reduced radially inward and would tend to create a void in the outer perimeter of the spray pattern. By appropriate choice of the spring rate of springs 54, the spray nozzle 10 will automatically adjust the cross-sectional area of annular nozzle opening 50 so as to maintain a substantially uniform spray pattern over a wide range of fluid supply pressures and flow rates.

The nozzle body 12 and the cap 14 are preferably constructed of a durable polymeric material, such as acetyl.

The turbine 16 includes a mounting ring 70 sized to be positioned about the nozzle body 12, a plurality of fins 72 extending circumferentially about a bottom surface 74 of the nozzle body 12, and a central hub 76 extending radially inwardly of the mounting ring 70 for maintaining the fins 72 in an operable relationship with the nozzle opening 50. The turbine 16 is preferably formed of a polymeric material, such as nylon.

The mounting ring 70 serves as a base or connector for the fins 72 and the central hub 76. The mounting ring 70 is preferably circularly shaped with an inner diameter greater than the outer diameter of the nozzle body 12 so that an inner peripheral side 78 (FIG. 2) is capable of being maintained in a non-contact relationship with the outer surface of the nozzle body 12 to eliminate undue interference with rotation of the turbine 16.

Figure 5:
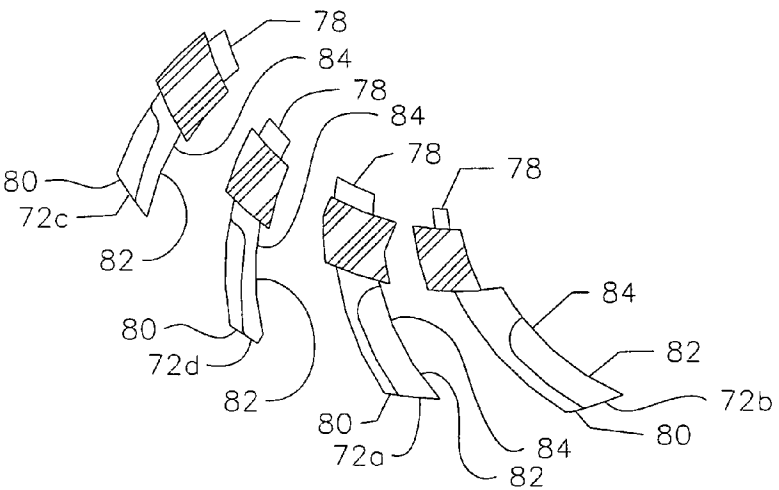
FIG. 5 is a partial cross sectional, top plan view of a portion of the turbine.
Figure 4:
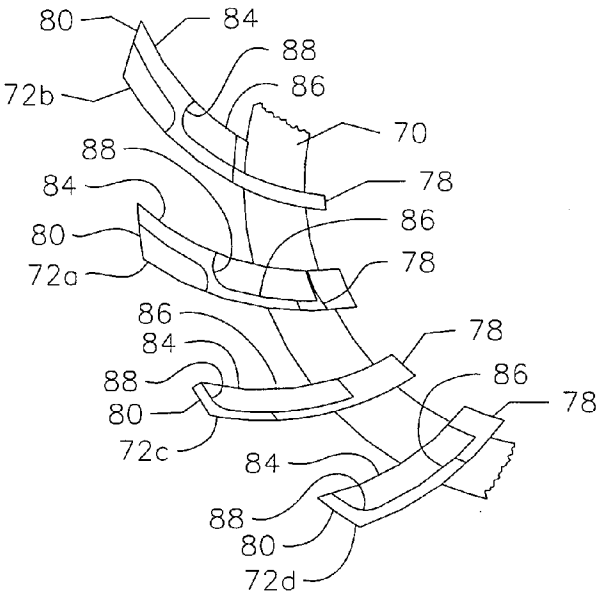
FIG. 4 is a bottom plan view of a portion of a turbine.

Referring now to FIGS. 1, 4, and 5, the turbine 16 is shown as sixteen fins 72. The sixteen fins 72 are configured in four repeating sets about the turbine 16. Each set of fins includes fins 72*a*-72*d*, each of which is sized and configured to distribute fluid over various portions of the square spray pattern. That is, the fins 72*a*-72*d* are not identically constructed. The fin 72*a* is designed to deflect fluid near the central area of the square spray pattern, the fin 72*b* to an intermediate area, and the fins 72*c* and 72*d* to an outer perimeter area of the square spray pattern. The two fins 72*c* and 72*d* of the set of fins are utilized to deflect fluid to the outer perimeter area for the reason that the outer perimeter area encompasses more area than the central area of the square spray pattern. It will be understood that there can of course be overlap of fluid distribution of the various fins 72*a*-72*d*. Also, each of the fins 72*a*-72*d* will contribute to deflecting fluid back and radially inward below the cap 14 to eliminate a central void in the spray pattern below the cap 14.

The fins 72 extend radially outward from the bottom surface 74 of the mounting ring 70 so that the fins 72 are positioned to intercept the fluid exiting the nozzle opening 50. Each of the fins 72 has a leading edge 78, a trailing edge 80, and a radial surface 82 for directing the flow of fluid radially outward from the nozzle opening 50. The radial surface 82 is configured to have an upper section 84 and a lower section 86. The lower section 86 of the radial surface 82 is formed so as to be offset laterally from the upper section 84. The fins 72 are supported relative to the nozzle opening 50 so that the boundary between the upper section 84 and the lower section 86 substantially bisects nozzle opening 50 so that a portion of the fluid exiting the nozzle opening 50 flows across the upper section 84 and a portion of the fluid flows across the lower section 86. The lower section 86 has a configuration that is different than the configuration of the upper section 84 such that the upper section 84 and lower section 86 of the fins 72 direct fluid exiting the nozzle opening 50 in different directions.

In particular, the lower section 86 of the radial surface 82 is formed to have a vane 88 extending at an angle relative to the radial surface 82 of the lower section 86 so as to redirect the flow of fluid passing along the lower section 86. The direction and pattern that the fluid comes off of each of the fins 72*a*-72*d* is dependent on several factors. These factors include the angle of the leading edge 78, the length of the radial surface 82, the position of the vane 88 along the length of the radial surface 82, and the angle of the vane 88.

In general, fluid exists the nozzle opening 50 and comes into contact with the fins 72. A portion of the fluid will contact the leading edge 134 which will deflect that portion of the fluid back and radially inward below the cap 14. The angle of the leading edge 134 of the fins 72*a*-72*d* is shown to be different for each of the fins 72*a*-72*d*. The remainder of the fluid will engage the radial surface 82 of the upper section 84 and the lower section 86 thereby applying a force to cause the turbine 16 to rotate. As the turbine 16 is rotating, the fluid will flow radially outward along the radial surface 82 of the upper section 84 and the lower section 86. With respect to the lower section 86, the fluid will come into contact with the vane 88 which is generally oriented tangentially to the radial surface 82. As such, the vane 88 will function as a splash plate breaking up the flow of fluid. Where the spray of fluid falls along the radius of the spray pattern is dependent again on the location of the vane 88 along the length of the radial surface 82 and the angle of the vane 88. With respect to the upper section 84, the length of the radial surface 82 will be the primary factor in determining where the fluid falls along the radius of the spray pattern.

By way of example, the length of the upper section 84 of the upper section 84 of the radial surface 82 of the fin 72*a* may be about 1.56 inches, the length of the lower section 86 of the radial surface 82 about 0.90 inches, and the radius of the vane 88 about 0.15 inches. The length of the upper section 84 of the radial surface 82 of fin 72*b* may be about 1.35 inches, the length of the lower section 86 of the radial surface 82 about 0.62 inches, and the radius of the vane 88 about 0.15 inches. The length of the upper section 84 of the radial surface 82 of fin 72*c* may be about 1.40 inches, the length of the lower section 86 of the radial surface 82 about 1.16 inches, and the radius of the vane 88 about 0.18 inches. The length of the upper section 84 of the radial surface 82 of fin 72*d* may be about 1.25 inches, the length of the lower section 86 of the radial surface 82 about 0.95 inches, and the radius of the vane 88 about 0.18 inches.

Although specific lengths and angles have been provided for each of the sixteen turbine fins 72, it should be appreciated by one of ordinary skill in the art that either the lengths or angles can be varied from the given values to fit or coincide with the particular application of the spray nozzle 10. As such, the specific values set forth hereinabove with respect to the lengths and angles of the sixteen fins 72 should not be regarded as limiting and other angles and lengths which accomplish the goal of dispersing fluid from the spray nozzle 10 in a square pattern and at a substantially constant volume across the entirety of the substrate are contemplated for use and as being a part of the invention claimed and disclosed herein.

Although a preferred embodiment of the fins of the turbine have been shown and described, it should be appreciated by one of ordinary skill in the art that a variety of configurations of fins may be used to accomplish the goal of dispersing fluid from the spray nozzle 10 in a square pattern and at a substantially constant volume across the entirety of the substrate and such fins are contemplated for use and as being a part of the invention claimed and disclosed herein.

Returning to FIGS. 1 and 2, the central hub 76 of the turbine 16 is supported by a plurality of support members 90 having a portion 90*a* extending downwardly from the bottom surface 74 of the mounting ring 70 and another portion 90*b* extending a distance inwardly. The support members 90 extend downward a sufficient distance so that the central hub 76 is capable of being centrally positioned on the lower side of the cap 14 while the fins 72 are operably positioned about the nozzle opening 50. The turbine 16 has been illustrated as having four support members 90. However, it will be appreciated by those of ordinary skill in the art that the number of support member 90 utilized may be varied so long as the turbine 16 is maintained in a stable relationship with respect to the nozzle body 12. Horizontal portions 90*b* of the support members 90 are reinforced with braces 94 which extend therebetween.

The central hub 76 is provided with a bore 96 extending therethrough. The central hub 76 is connected to the cap 14 along the longitudinal axis of the cap 14 via a threaded shaft 98. The shaft 98 has a first end 100, a second end 102, and an intermediate portion 104. The first end 100 of the shaft 98 is received in the bore 96 and secured thereto with a lock nut 106. The intermediate portion 104 of the shaft 98 extends through a bearing 108 fixed in the counterbore 34 of the cap 14 while the second end 102 of the shaft 98 extends into the cavity 32 of the cap 14.

It will be appreciated that by having the turbine 16 connected to the cap 14 via the shaft 98, no portion of the turbine 16 is positioned within the nozzle opening 50. As such, should the turbine 16 be subjected to the accumulation of solids, the increased weight caused by the solids on the turbine 16 will not lead to the failure of the turbine 16.

Another advantage of connecting the turbine 16 to the cap 14 via the shaft 98 is that the rotating shaft 98 may be used to drive a grinder assembly 110 and thereby reduce the tendency of the spray nozzle 10 from becoming clogged by debris. The grinder assembly 110 is fixed to the second end 102 of the shaft 98 so that the grinder assembly 110 is caused to rotate in response to rotation of the turbine 16.

The grinder assembly 110 includes a plate or disk 112 linked to the turbine 16 via the shaft 98. The plate 112 is generally shaped to conform to the shape of the cavity 34 of the cap 14. In the embodiment depicted in FIGS. 1 and 2, the plate 112 is circular. However, the plate 112 could be constructed to have a variety of configurations. The plate 112 has an upper surface 114 that is in alignment with the fluid passage 18 of the nozzle body 12 when the plate 112 is connected to the second end 102 of the shaft 98. The upper surface 114 of the plate 112 has a groove 116 that extends generally diametrically across the upper surface 114 of the plate 112.

To effect the grinding of debris contained with the flow of fluid passing through the nozzle body 12 toward the nozzle opening 50, a grinding member 120 is secured in the groove 116 of the plate 112. The grinding member 120 may be a conventional de-burring tool that is adapted to be connected to a drill. That is, the grinding member 120 shown in FIGS. 1 and 2 has a shank 122 and a cutting head 72. As an alternative to the grinding member 120 described above, it will be appreciated that the upper surface of the plate 112 may be laminated or impregnated with a grinding material or a sheet containing a grinding material, or the plate 112 formed to have an integral cutting member.

A secondary grinder may be provided on the turbine 16 so that any debris, such as twigs, that may bypass the grinder assembly 110 and become lodged in the nozzle opening 50, may be ground so as not to significantly interfere with the operation of the turbine 16. More specifically, a vertical portion of a support member 90*a* is provided with a bore 132 extending from the upper surface of the mounting ring 70 and sized and dimensioned to receive a grinding member 78. The support member 90*a* has an opening 80 formed therein such that a cutting head 82 of the grinding member 78 is exposed and positioned adjacent the nozzle opening 50 so that debris exiting the nozzle opening 50 may engage the cutting head 82. It will be appreciated that the turbine 16 may be constructed to receive additional grinder members if desired.

Figure 6:
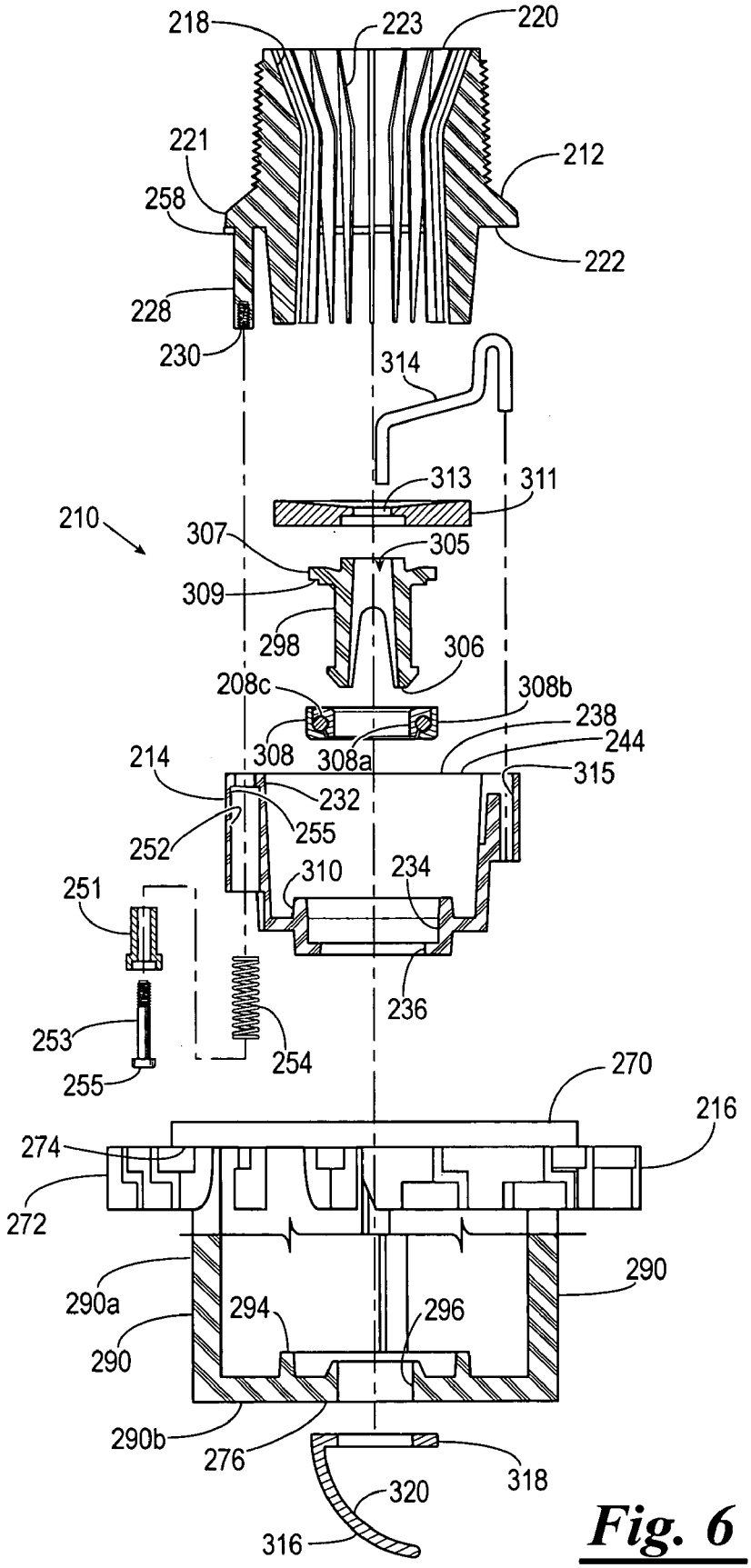
FIG. 6 is an exploded, partial cutaway, sectional view of another embodiment of a spray nozzle constructed in accordance with the present invention.
Figure 7:
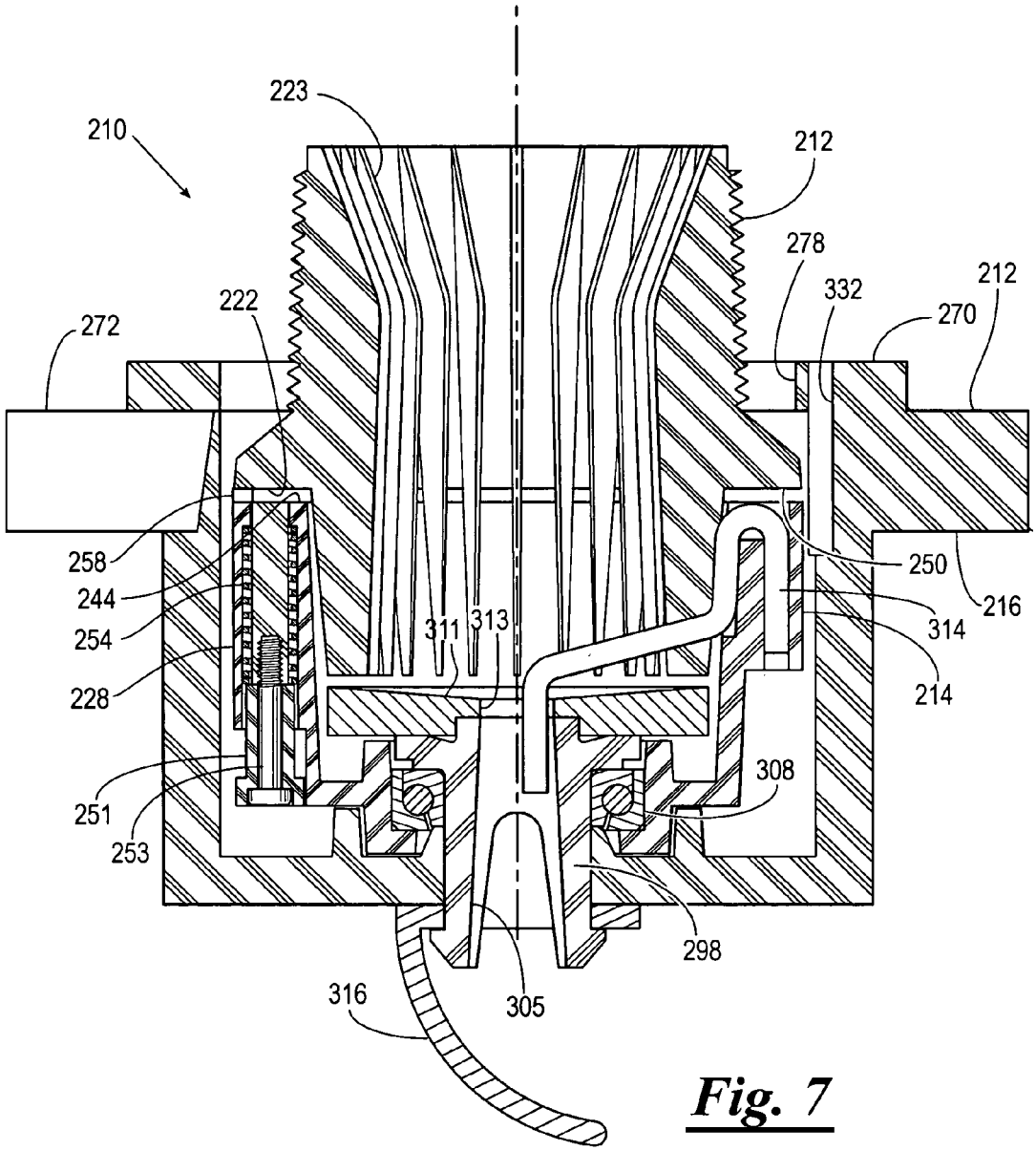
FIG. 7 is a rotated sectional view of the spray nozzle of FIG. 6.
Figure 8:
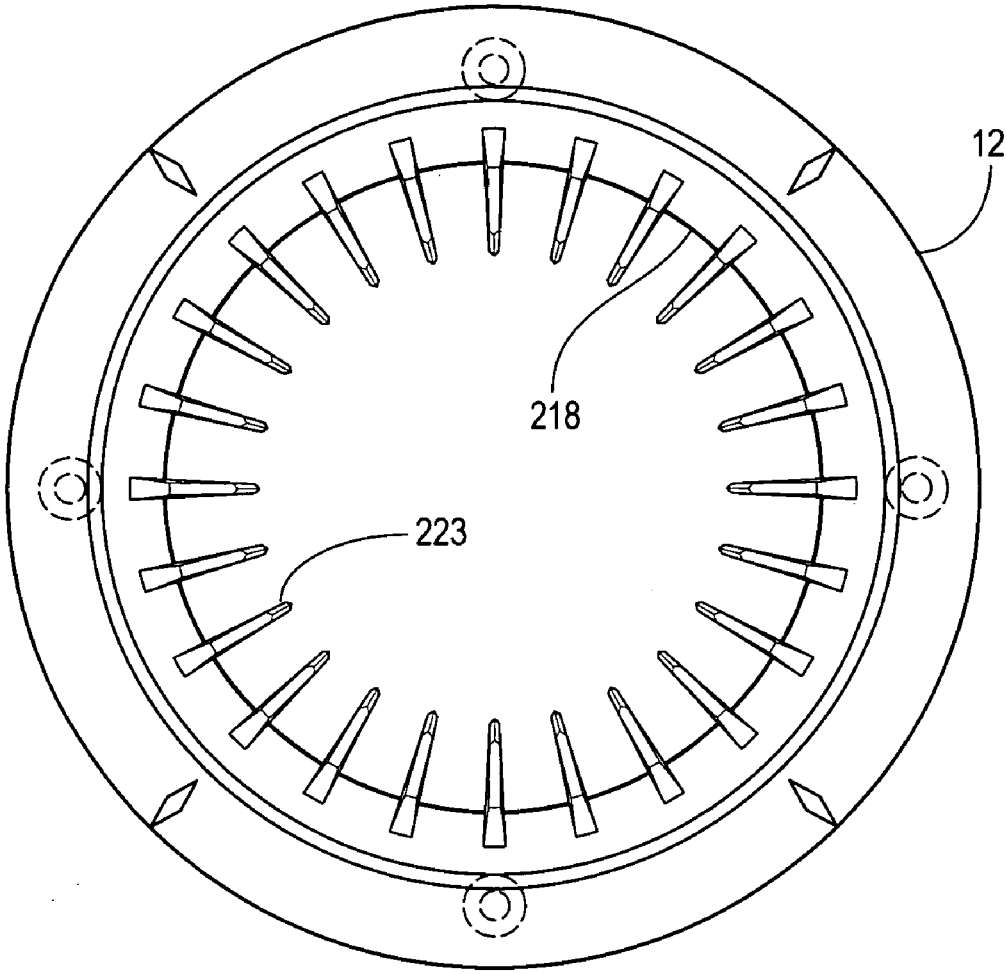
FIG. 8 is a top plan view of a nozzle body.

Referring now to FIGS. 6–8, shown therein is another embodiment of a spray nozzle 210 constructed in accordance with the present invention. The spray nozzle 210 includes a nozzle body 212, a cap 214, and a turbine 216.

The nozzle body 212 is a generally tubular member defining a fluid passage 218 (FIG. 6). The nozzle body 212 has a threaded inlet end 220 for connecting the nozzle body 212 to a fluid distributing header (not shown) and an outlet end 221 provided with an irregular shaped annular surface 222.

To contain and direct debris contained in the flow of fluid along a generally central path through the fluid passage 218 and to prevent vortical fluid flow, the nozzle body 212 is provided a plurality of fins 223 (FIGS. 6–8) circumferentially spaced and extending radially into the fluid passage of the nozzle body 212. The fins 223 are equally spaced about the interior surface of the nozzle body 212. Each of the fins 223 tapers from the inlet end 220 toward the outlet end 221 of the nozzle body 212 such that the space between each of the fins 223 increases from the inlet end 220 to the outlet end 221 to permit any debris that may wedge between the fins 223 to work free. The fins 223 extend beyond the annular surface 222 of the nozzle body 212.

The irregular shaped annular surface 222 is an undulating surface having four peaks (although not shown in FIG. 6 & &) equally spaced at 90 degree intervals about the circumference of annular surface 222 and four troughs located between the peaks and also being substantially equally spaced similar to that shown and described above for the spray nozzle 10. One of the troughs is located equidistant between each adjacent pair of peaks.

The nozzle body 212 is further provided with a plurality of guide posts 228 extending downwardly from the peaks of the annular surface 222. Each guide post 228 has a threaded opening 230 (FIG. 6) formed in the distal end thereof. While only one guide post 228 is shown, it should be understood that the number of guide posts 228 is preferably four, but may be varied so long as the spray nozzle 210 functions in the manner to be described below.

The cap 214 is a generally cylindrically shaped, closed ended member defining a cavity 232 (FIG. 6) having a sufficient depth to collect debris. The cap 214 is provided with a central counterbore 234 and an opening 236 which is in communication with the counterbore 234. The cap 214 has a rim 238 that defines an annular surface 244 which has a substantially planar configuration. The cap 214 is connected to the nozzle body 212 so that the annular surface 222 of the nozzle body 212 and the annular surface 244 of the cap 214 are spaced apart from one another to define a substantially annular nozzle opening 250 (FIG. 7) therebetween. Because of the irregular shape of the surface 222, the spacing between the surface 222 and the surface 244 varies around a circumference of the annular nozzle opening 250 to create a non-circular spray pattern of fluid exiting the nozzle opening 250. In particular, a generally square spray pattern will be provided due to the formation of four troughs and four peaks. The fluid flowing past the peaks will define the corners of the square pattern because the peaks cause a flow restriction which increases the pressure of the fluid and thus causes the fluid to flow farther than the fluid flowing past the troughs.

To connect the cap 214 to the nozzle body 212, the cap 214 is provided with a plurality of holes 252 spaced about the periphery of the cap 214 and sized to slidably receive the guide posts 228 of the nozzle body 212. The cap 214 is connected to the nozzle body 212 with a plurality of spring retainers 251, a plurality of fasteners 253, such as screws, and a plurality of compression springs 254. The compression springs 254 are positioned in the holes 252 and about the guide posts 228 of the nozzle body 212 and engaged with an annular shoulder 255. The spring retainer 251 and the fastener 253 are then secured to the opening 230 of the guide posts 228. Each of the spring retainers 251 have a head 255 that limits the movement of the cap 214 relative to the nozzle body 212.

The slidable mounting of the cap 214 on the nozzle body 212 in combination with the use of the compression springs 254 provides an automatic adjusting mechanism for increasing the spacing between the first and second annular surfaces 222 and 244 in response to an increase in fluid pressure in the annular nozzle opening 250.

The cap 214 is shown in FIG. 7 in an initial position wherein a minimum spacing between the annular surfaces 222 and 244 is defined by a stop members 258 formed adjacent the proximal end of each of the guide posts 228 of the nozzle body 212. When fluid pressure supplied to the spray nozzle 210 is increased, the increased downward force acting on the cap 214 will compress the springs 254 to increase the spacing between annular surfaces 222 and 244. As an example, the spray nozzle 210 will be designed with an initial minimum clearance between surfaces 222 and 244 at the peaks of 0.07 inches. Preferably, the spring retainers 251 are sized 0.25 inches so that maximum clearance between surfaces 222 and 244 will be 0.32 inches.

It will be appreciated that in the absence of the automatic nozzle adjustment provided by the spring 254 and the sliding engagement of cap 214 with the guide posts 228, a substantial increase in fluid supply pressure would cause the spray pattern to be extended radially outward to an undue extent and would tend to create a void in the center of the pattern. Conversely, a decrease in flow supply pressure would cause the spray pattern to be reduced radially inward and would tend to create a void in the outer perimeter of the spray pattern. By appropriate choice of the spring rate of springs 254, the spray nozzle 210 will automatically adjust the cross-sectional area of the annular nozzle opening 250 so as to maintain a substantially uniform spray pattern over a wide range of fluid supply pressures and flow rates.

The nozzle body 212 and the cap 214 are preferably constructed of a durable polymeric material, such as acetyl.

The turbine 216 includes a mounting ring 270 sized to be positioned about the nozzle body 212, a plurality of fins 272 extending circumferentially about a bottom surface 274 of the mounting ring 270, and a central hub 276 extending radially inwardly of the mounting ring 270 for maintaining the fins 272 in an operable relationship with the nozzle opening 250. The fins 272 are shown to be identical in construction to the fins 72 described above. However, it will be appreciated that the configuration of the fins 272 may be varied. The turbine 216 is preferably formed of a polymeric material, such as nylon.

The mounting ring 270 serves as a base or connector for the fins 272 and the central hub 276. The mounting ring 270 is preferably circularly shaped with an inner diameter greater than the outer diameter of the nozzle body 212 so that an inner peripheral side 278 (FIG. 7) is capable of being maintained in a non-contact relationship with the outer surface of the nozzle body 212 to eliminate undue interference with rotation of the turbine 216.

The central hub 276 of the turbine 216 is supported by a plurality of support members 290 having a portion 290*a* extending downwardly from the bottom surface 274 of the mounting ring 270 and another portion 290*b* extending a distance inwardly. The support members 290 extend downward a sufficient distance so that the central hub 276 is capable of being centrally positioned on the lower side of the cap 214 while the fins 272 are operably positioned about the nozzle opening 250. The turbine 216 has four support members 290. However, it will be appreciated by those of ordinary skill in the art that the number of support members 290 utilized may be varied so long as the turbine 216 is maintained in a stable relationship with respect to the nozzle body 212. Horizontal portions 290*b* of the support members 290 are provided with a generally circular stabilizing lip 294 which extends therebetween.

The central hub 276 is provided with a bore 296 extending therethrough. The central hub 276 is connected to the cap 214 along the longitudinal axis of the cap 214 via a shaft 298. The shaft 298 has a flow passage 305 extending longitudinally therethrough. One first end of the shaft 298 is received in the bore 296 and is provided with a plurality of flexible retaining members 306 over which the central hub 276 is received. The other end of the shaft 298 extends into the cavity 232 of the cap 214 and is provided with a plate 307 generally shaped to conform to the shape of the cavity 234 of the cap 214. An intermediate portion of the shaft 298 extends through a bearing assembly 308 fixed in the counterbore 234 of the cap 214.

The bearing assembly 308 has an inner race 308*a*, an outer race 308*b*, and a plurality of ball bearings 308*c*. Preferably, the bearing assembly 308 is constructed such that the inner race 308*a* is able to move relative to the outer race 308*b* upon the outer race 308*b* becoming worn due to the travel of the ball bearings 308*c* along the outer race 308*b* and thereby prevent the gap between the inner race 308*a* and the outer race 308*b* from increasing to cause the bearing assembly 308 to fail or operate less effectively. The intermediate portion of the shaft 298 is press fit in the inner race 308*a* and is adapted to move in a downward direction along with the inner race 308*a*. More specifically, a lower side of the plate 307 has an annular recess 309 adapted to receive the outer race 308*b* as the inner race 308*a* and the shaft 298 travel downward as the outer race 308*b* erodes.

The cap 214 further includes a circular shield 310 extending from the inner surface of the cap 214 concentrically about the counter bore 234. The shield 310 serves as a barrier against debris entering the bearing assembly 308.

It will be appreciated that by having the turbine 216 connected to the cap 214 via the shaft 298, no portion of the turbine 216 is positioned within the nozzle opening 250. As such, should the turbine 216 be subjected to the accumulation of solids, the increased weight caused by the solids on the turbine 216 will not lead to the failure of the turbine 216.

Another advantage of connecting the turbine 216 to the cap 214 via the shaft 298 is that the rotating shaft 298 may be used to drive a grinding member 311 and thereby reduce the tendency of the spray nozzle 210 from becoming clogged by debris. The grinding member 311 is fixed to the second end of the shaft 298 so that the grinding member 311 is caused to rotate in response to rotation of the turbine 216. More specifically, the grinding member 311 is connected to the plate 307 of the shaft 298. The grinding member 311 may be a grinding stone with a central opening 313 having a diameter substantially equal in size to the diameter of the flow passage 305 of the shaft 298 to permit water and debris to flow therethrough. However, the grinding member 311 may be any suitable device capable of cutting or eroding debris that engages the grinding member 311. Additionally, the grinding member 311 may be positioned in a variety of other locations. For example, the grinding member 311 may extend into the nozzle body 312.

The grinding member 311 may be shaped to funnel inwardly to the central opening 313 to guide debris toward the central opening 313. The grinding member 311 is secured to the plate 307 in a suitable fashion, such as with an adhesive. To keep the central opening 313 of the grinding member 311 and the flow passage 305 of the shaft 298 free of debris that may interfere with the rotation of the turbine 216 or prevent the discharge of debris from the cap 214, a scraper bar 314 is positioned within the central opening 313. The scraper bar 314 is a finger-like member having one end adapted to be mounted in a recess 315 of the cap 214 and an opposing end positioned within the central opening 314 of the grinding member 311. The portion of the scraper bar 314 positioned within the central opening 314 of the grinding member 311 functions to wipe away and dislodge any debris from the central opening 314 as the grinding member 311 rotates relative to the scraper bar 314. The inner edge of the grinding member 311 may also function as a cutting member which cooperates with the scraper bar 314 to erode debris that may be too large to pass through the central opening 313.

To further facilitate the passage of debris through the flow passage 305 of the shaft 298, the flow passage 305 is tapered from the lower end to the upper end so that debris that does pass through the central opening 313 and the upper end of the shaft 298 will continue to flow freely through the flow passage 305 and be discharged from the cap 214.

A diffuser 316 is mounted to the lower end of the shaft 298 so as to intercept the fluid and debris discharged from the flow passage 305 and cause the fluid to be evenly distributed. The diffuser 316 has a ring portion 318 sized to be received about the lower end of the shaft 298 and an arcuate finger portion 320 that extends from the ring portion 318 and into alignment with the flow passage 305 of the shaft 298. The diffuser 316 is connected to the shaft 298 such that the diffuser 316 is caused to rotate with rotation of the turbine 216. As such, the arcuate finger portion 320 rotates and deflects the fluid discharged from the fluid passage 305 in a generally circular pattern about the axis of the fluid passage 305.

Like the spray nozzle 10, a secondary grinder (not shown) may be provided on the turbine 216 so that any debris, such as twigs, that may bypass the grinding member 311 and become lodged in the nozzle opening 250, may be ground so as not to significantly interfere with the operation of the turbine 216. More specifically, a vertical portion of a support member 290*a* is provided with a bore 332 extending from the upper surface of the mounting ring 270 and sized and dimensioned to receive a grinding member like the grinding member 311 described above.

Figure 9:
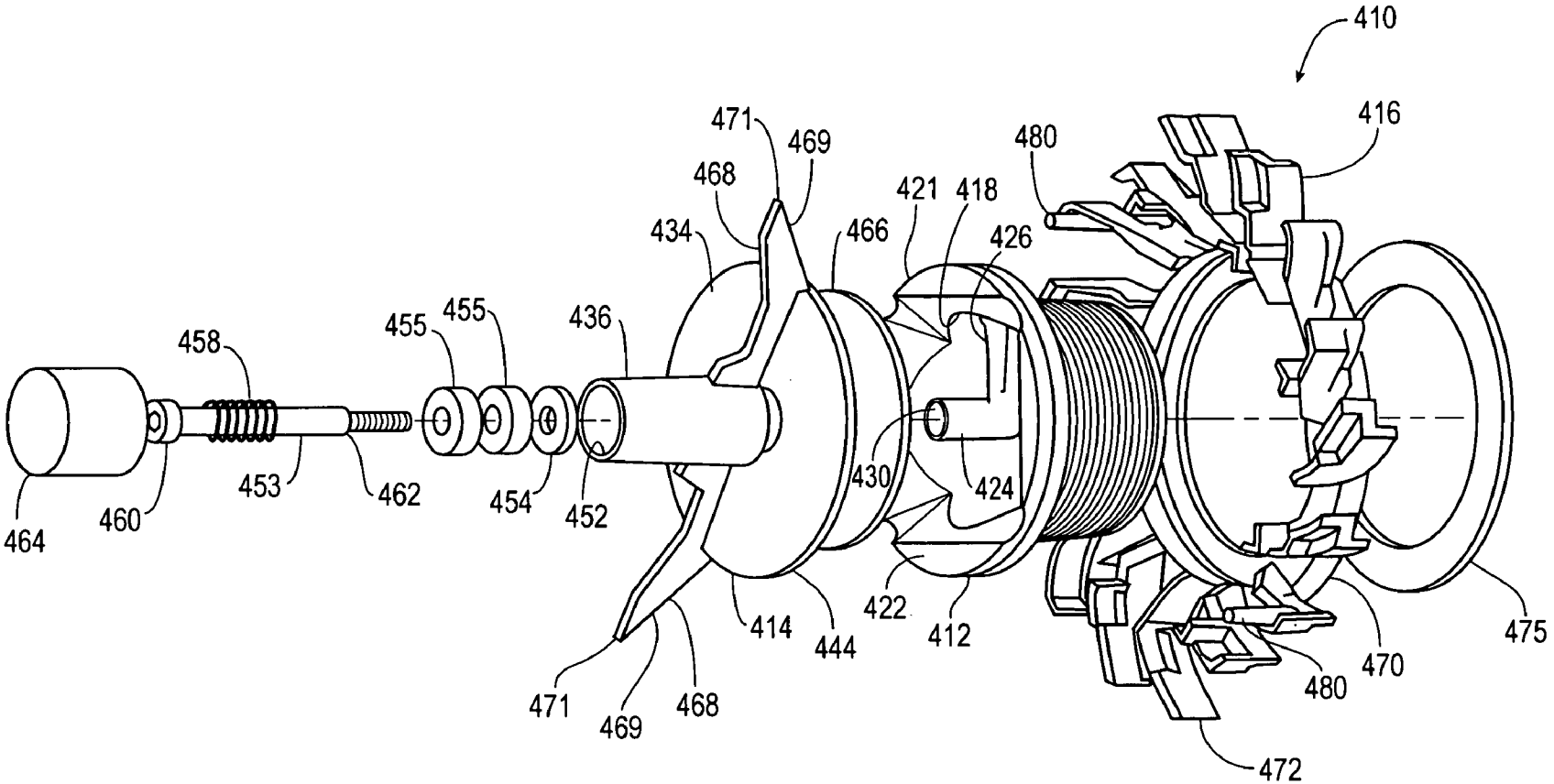
FIG. 9 is an exploded, perspective view of another embodiment of a spray nozzle constructed in accordance with the present invention.
Figure 10:
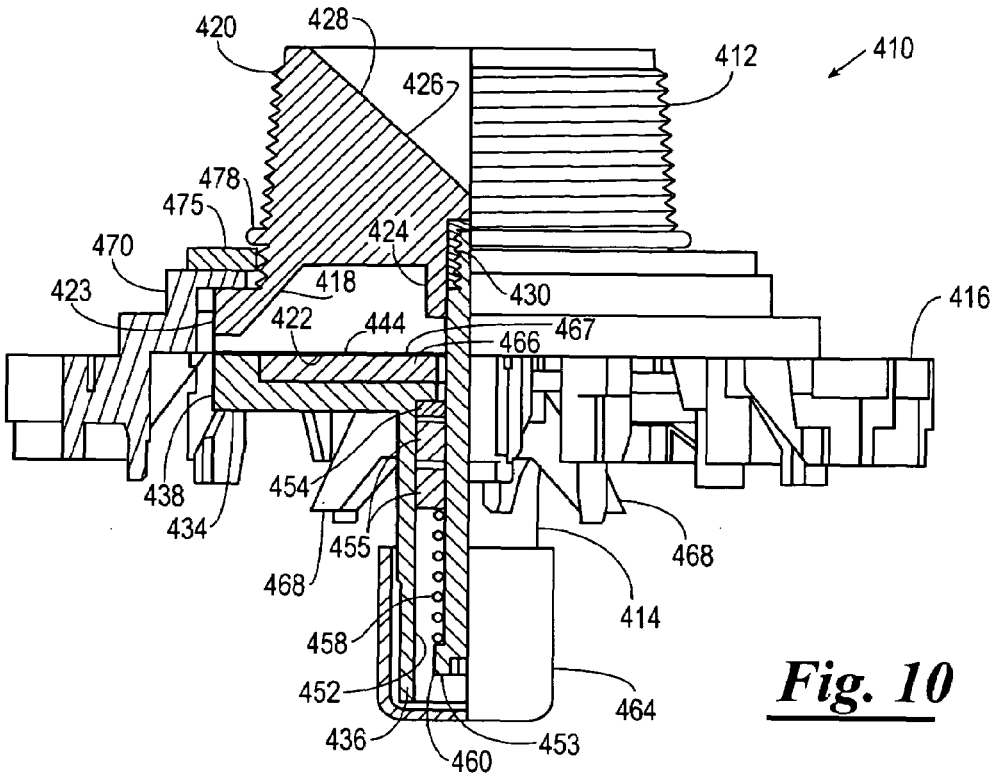
FIG. 10 is a partially sectional, elevational view of the spray nozzle of FIG. 9 shown in an un-pressurized condition.
Figure 11:
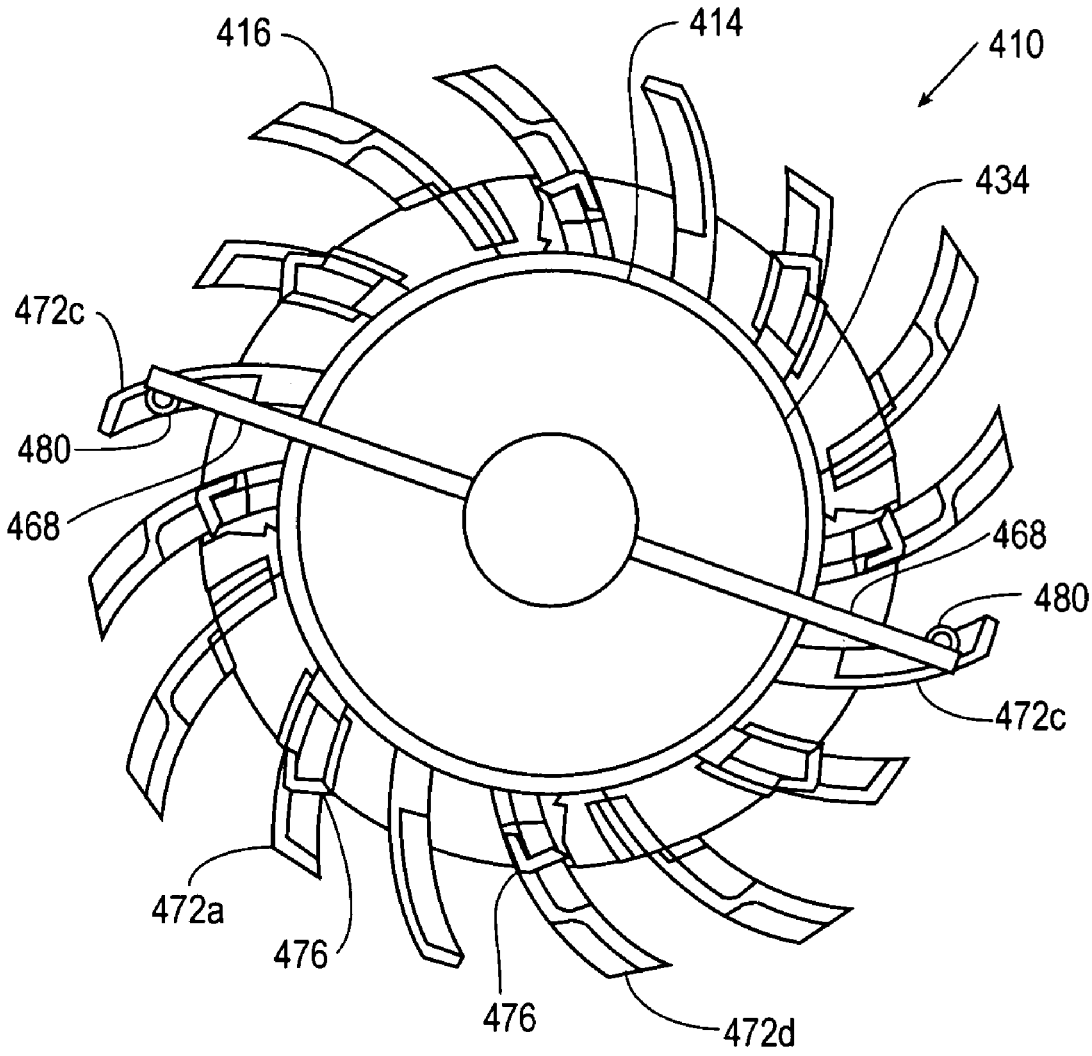
FIG. 11 is a bottom plan view of the spray nozzle of FIG. 9.

Referring now to FIGS. 9–11, shown therein is another embodiment of a spray nozzle 410 constructed in accordance with the present invention. The spray nozzle 410 includes a nozzle body 412, a cap 414, and a turbine 416.

Figure 10A:
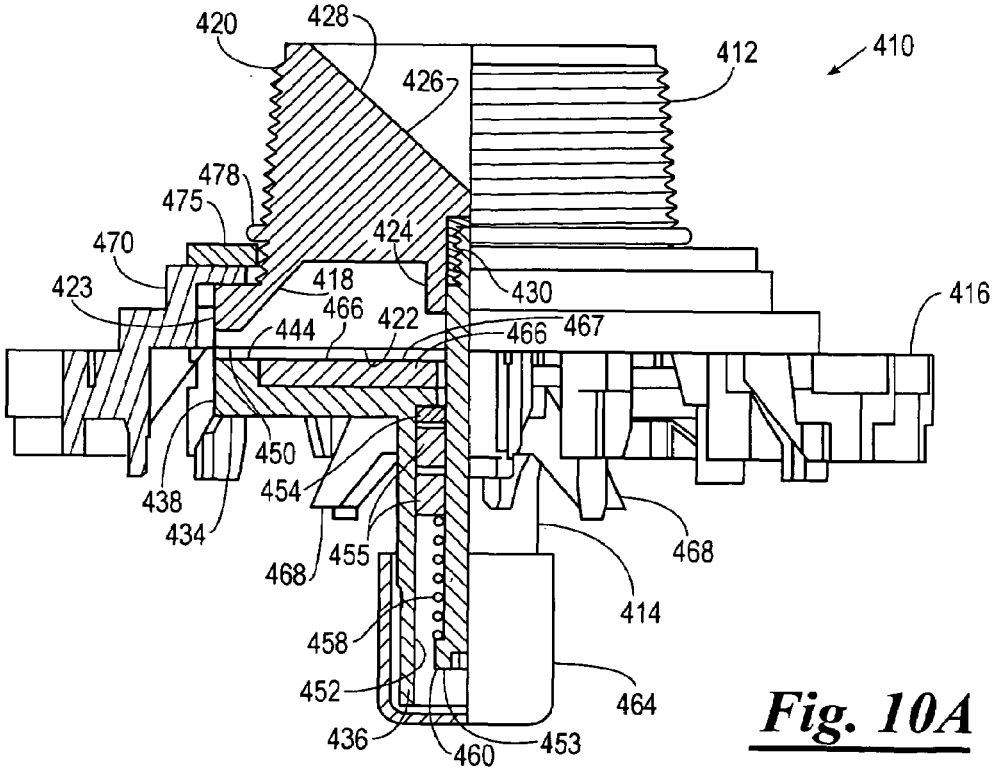
FIG. 10A is a partially sectional, elevational view of the spray nozzle of FIG. 9 in a pressurized condition.

The nozzle body 412 is a generally tubular member defining a fluid passage 418 (FIGS. 9, 10, and 10A). The nozzle body 412 has a threaded inlet end 420 for connecting the nozzle body 412 to a fluid distributing header (not shown) and an outlet end 421 provided with a flange 423 having an irregular shaped annular surface 422.

The irregular shaped annular surface 422 is an undulating surface having four peaks (although not shown in FIGS. 9 and 10) equally spaced at 90 degree intervals about the circumference of annular surface 422 and four troughs located between the peaks and also being substantially equally spaced similar to that shown and described above for the spray nozzle 10. One of the troughs is located equidistant between each adjacent pair of peaks.

The nozzle body 412 is further provided with a central hub 424. The central hub 424 is fixed within the fluid passage 418 of the nozzle body 412 with a radial support arm 426 (FIG. 10). The radial support arm 426 has an upper surface 428 (FIGS. 10 and 10A) angled inwardly and downwardly to facilitate debris sliding off the radial support arm 426. The radial support arm 426 further functions to prevent vortical fluid flow. The central hub 424 is provided with a threaded opening 430. In one version, the threaded opening 430 is defined by a metal fixture.

The cap 414 has a disk portion 434 and a hub portion 436. The disk portion 434 has a rim 438 that defines an annular surface 444 which has a substantially planar configuration. The cap 414 is connected to the nozzle body 412 so that the annular surface 422 of the nozzle body 412 and the annular surface 444 of the cap 414 define a nozzle opening 450 therebetween (best shown in FIG. 10A). More specifically, the cap 414 is connected to the nozzle body 412 so that a portion of the annular surface 422 of the nozzle body 412 and the annular surface 444 of the cap 414 are engaged when the spray nozzle 210 is in an un-pressurized condition. However, when pressurized, the annular surface 422 of the nozzle body 412 and the annular surface 444 of the cap 414 become spaced apart from another. The advantage of this feature will be described below.

Because of the irregular shape of the surface 422, the spacing between the surface 422 and the surface 444 varies around a circumference of the annular nozzle opening 450 to create a non-circular spray pattern of fluid exiting the nozzle opening 450. In particular, a generally square spray pattern will be provided due to the formation of four troughs and four peaks. The fluid flowing past the peaks will define the corners of the square pattern because the peaks cause a flow restriction which increases the pressure of the fluid and thus causes the fluid to flow farther than the fluid flowing past the troughs.

To connect the cap 414 to the nozzle body 412, the hub portion 436 of the cap 414 is provided with a longitudinal bore 452 extending through the disk portion 434. The cap 414 is connected to the nozzle body 412 with a fastener 453, such as a shoulder bolt, so that the cap 414 is rotatable relative to the nozzle body 412. A seal member 454 and a pair of bearings 455 are inserted in the longitudinal bore 452 to engage a shoulder 456. A compression spring 458 is also positioned in the longitudinal bore 452. The fastener 453 is slidably disposed through the compression spring 458, the bearings 455, and the seal member 454 and fastened to the nozzle body 412. The fastener 453 has a head 460 for retaining the compression spring 458 and a shoulder 462 that engages a distal end of the threaded opening 430 to preload the compression spring 458 a predetermined distance. The longitudinal bore 452 is filled with a lubricant (not shown) and sealed with a hub cap 464.

The slidable mounting of the cap 414 on the nozzle body 412 in combination with the use of the compression springs 458 provides an automatic adjusting mechanism for increasing the spacing between the first and second annular surfaces 422 and 444 in response to an increase in fluid pressure in the annular nozzle opening 450. The cap 414 is shown in FIG. 10 in an initial position wherein portions of the annular surfaces 422 and 444 are engaged. When fluid pressure supplied to the spray nozzle 410 is increased, the increased force acting on the cap 414 will compress the spring 458 to increase the spacing between annular surfaces 422 and 444, as shown in FIG. 10A.

As described above in reference to the spray nozzle 10 and the spray nozzle 210, a minimum spacing between the annular surfaces is defined by stop members. One problem of requiring a minimum spacing between the annular surfaces is that tight tolerances are also required. That is, should the minimum spacing for each spray nozzle in an array of spray nozzles not be substantially identical, then the uniformity of the distribution of fluid may be negatively affected when fluid pressure is supplied to the spray nozzles. By causing the first and second annular surfaces 422 and 444 of the spray nozzle 410 to engage in a non-pressurized condition, the need to maintain tight tolerances with respect to the minimum spacing between the annular surfaces 422 and 444 is eliminated. Instead, the reaction of the cap 414 to fluid pressure is dependent on the tension of the compression spring 458.

It will be appreciated that in the absence of the automatic nozzle adjustment provided by the spring 458 and the sliding engagement of cap 414 with the nozzle body 412, a substantial increase in fluid supply pressure would cause the spray pattern to be extended radially outward to an undue extent and would tend to create a void in the center of the pattern. Conversely, a decrease in flow supply pressure would cause the spray pattern to be reduced radially inward and would tend to create a void in the outer perimeter of the spray pattern. By appropriate choice of the spring rate of the spring 458, the spray nozzle 410 will automatically adjust the cross-sectional area of the annular nozzle opening 450 so as to maintain a substantially uniform spray pattern over a wide range of fluid supply pressures and flow rates.

The nozzle body 412 and the cap 414 are preferably constructed of a durable polymeric material, such as acetyl.

The spray nozzle 410 further includes a grinding member 466 to reduce the tendency of the spray nozzle 410 from becoming clogged by debris. As shown in FIG. 10, the grinding member 466 is secured to the cap 414. The grinding member 466 may be a grinding wheel or stone with a central opening. The grinding member 466 is secured to the cap 414 in a suitable fashion, such as with an adhesive or by encapsulating the grinding member 466 in the disk portion 434 of the cap 414. The grinding member 466 is positioned so that a grinding surface is aligned with the fluid passage 418 of the nozzle body 412 and the grinding member 466 is caused to rotate in response to rotation of the turbine 416. The grinding member 466 may be any suitable device capable of cutting or eroding debris that engages the grinding member 466. Additionally, the grinding member 466 may be positioned in a variety of other locations. For example, the grinding member 466 may extend into the nozzle body 412.

The cap 414 is further provided with a pair of arms 468 extending outwardly in opposing directions beyond the perimeter of the disk portion 434 of the cap 414 so as to be engageable with a portion of the turbine 416 (FIG. 11). As best shown in FIG. 9, the arms 468 have an upper edge 469 angled downwardly from the disk portion 434 in the direction of the central hub 436. Further, the arms 468 are tapered so that a distal end of the arms 468 define a point 471. The functionality of the configuration of the arms 468 will be described further below in reference to the operation of the spray nozzle 410.

The turbine 416 includes a mounting ring 470 sized to be positioned about the nozzle body 412, yet engageable with the flange 423 of the nozzle body 412 so that the turbine 416 is rotatable about the nozzle body 412 and a plurality of fins 472 extending circumferentially about a bottom surface of the mounting ring 470, and a retaining ring 475 for securing the mounting ring 470 to the nozzle body 412 and maintaining the fins 472 in an operable relationship with the nozzle opening 450. The fins 472 are shown to be similar in construction to the fins 72 described above, with the exception that the fins 472*a* and 472*d* are provided with a deflector 476 to deflect fluid over the center of the spray pattern. The deflectors 476 are substantially L-shaped members extending downwardly from the fins 472*a* and 472*d*. The deflectors 476 are portioned near the inner edges of the fins 472*a* and 472*d*. However, because the inner edges of the fins 472*a* and 472*d* extend radially outward different distances, the deflector 476 of the fin 472*a* is positioned radially inward relative to the deflector 476 of the fin 476*d*, thereby creating a uniform spray pattern. However, it will be appreciated that the configuration of the fins 472 may be varied. The turbine 416 is preferably formed of a polymeric material, such as nylon.

The mounting ring 470 serves as a base or connector for the fins 472. The mounting ring 470 is preferably circularly shaped and contoured to substantially conform to the flange 423 of the nozzle body 412. The mounting ring 470 is secured to the nozzle body 412 with the retaining ring 475. The retaining ring 475 is positioned about the nozzle body 412 and over the mounting ring 470 of the turbine 416. The retaining ring 475 is secured to the nozzle body 412 by snapping the retaining ring 475 over a plurality of tabs 478 extending from the nozzle body 412. The tabs 478 are positioned so that when fluid pressure is applied to the nozzle body 412 and fluid is caused to exit the nozzle opening 450 and cause the turbine 416 to rotate, the mounting ring 470 is lifted off the upper surface of the flange 423 a distance to permit fluid to migrate between the flange 423 of the nozzle body 412 and the mounting ring 470 and create a fluid bearing which facilitates rotation of the turbine 416.

To effect rotation of the cap 414 and thus the grinding member 466, the turbine 416 is provided with a pair of posts 480 extending from opposing fins 472*c*. The posts 480 are positioned to engage the arms 468 of the cap 414 so as to drive the cap 414 in response to rotation of the turbine 416.

The arms 468 are dis-engageable from the posts 480 to permit debris, such as plastic bags, which may have been discharged from the nozzle opening 450 and become wrapped around one of the arms 468 to slide past the post 480 and off the arms 468 during use to prevent the debris from clogging the spray nozzle 410. More particularly, debris traveling outwardly and downwardly along the arms 468 and engaging the posts 480 force the arms 468 away from the posts 480. The debris is effectively forced past the post 480 for several reasons. First, the force of the water being discharged from the nozzle opening 450 pushes the debris outwardly. Second, the rotation of the turbine 416 and the cap 414 imparts a centrifugal force on the debris which has the effect of throwing the debris outwardly. Third, during use, the spray nozzle 410 will have a tendency to vibrate. The vibration of the arms 468 will enhance the travel of the debris along the arms 468. Finally, because the arms 468 are tapered and engage the posts 480 near the point 471 of the arms 468, the point of engagement between the arms 468 and the posts 480 is minimized.

Figure 12:
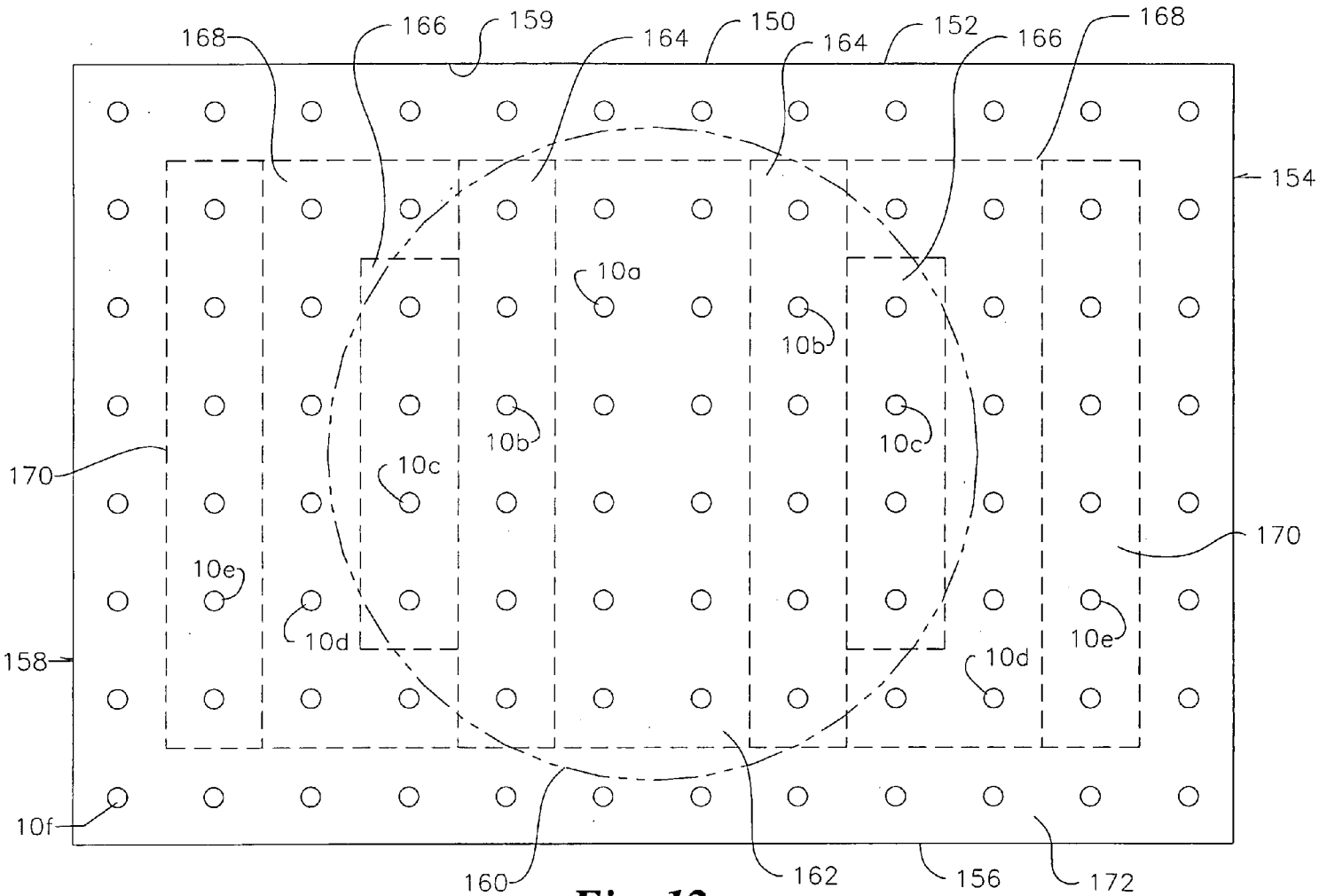
FIG. 12 is a top schematic view of a cooling tower cell having a plurality of spray nozzles constructed in accordance with the present invention arranged in a zonal pattern.

Referring now to FIG. 12, shown is a schematic representation of a cooling tower cell 150 with a plurality of spray nozzles 10 constructed in accordance with the present invention positioned for distributing water across a fill material (not shown). It should be appreciated that the cooling tower 150 is shown with spray nozzles 10 by way of example. Use of the spray nozzles 210 and 410 is also applicable. Cooling towers typically include a cooling tower frame having first, second, third and fourth sides 152, 154, 156 and 158, respectively. The four sides 152–158 form a rectangular frame that defines an air passageway 159. Each of the sides include air inlet openings (not shown) in the lower portion thereof for allowing air to be drawn through the side walls 152–158 and into the air passageway 159.

Layers of corrugated fill material (not shown) are positioned within the air passageway 159. The upper end of the frame supports an exhaust fan (not shown). A pump pulls water from a source through a supply line to a horizontal header to which the spray nozzles 10 are connected. Water is distributed by the spray nozzles 10 across the uppermost layer of fill material. The exhaust fan pulls air in through the air inlets and up through the air passageway 159 and layers of fill material in counterflow to the downwardly flowing water thereby cooling the water which is then collected in a basin and re-circulated or otherwise used as desired.

In a typical cooling tower cell, the exhaust fan will cause air to migrate upwardly through the cooling tower cell 150. The flow of air will have a tendency to be greater along a fan area 160 defined generally by a cylinder extending downward through the air passageway 159 from the perimeter of the fan. Air will travel along the path of least resistance and will tend to migrate upward in a circular pattern within the fan area 160. This central flow of air will starve the outer areas of the cooling tower cell 150 of air thereby significantly reducing the ability to achieve a balanced air to water mixture. The construction of cooling towers is further disclosed in U.S. Pat. No. 5,152,458, the entire contents of which are hereby expressly incorporated herein by reference.

As mentioned above, the spring tension of the springs 54 may be changed by adjusting the position of the fasteners 53 or substituting a spring having one spring tension for another spring having a different spring tension and thus allow the spray nozzle 10 to automatically adjust the cross-sectional area of annular nozzle opening 50 to maintain a substantially uniform spray pattern over a wide range of fluid supply pressures and flow rates.

In particular, the different spring tensions can be used to, in effect, change the size of the nozzle opening 50 and thus produce different water flow rates through each spray nozzle 10. This permits the flow rates of each spray nozzle 10 to be controlled in an effort to better balance the air to water mixture. Because the exhaust fan will cause air to migrate upwardly through the cooling tower cell 150 along the fan area 160, it is preferable to create a heavy water loading zone 162 in the fan area 160 and thus force a portion of the air out toward the perimeter of the cooling tower cell 150 to interact with the water distributed by the spray nozzles 10 outside the fan area 160. The heavy water loading 162 is achieved by using a spring which has a desired spring tension in the spray nozzles 10*a* located along a diametric axis 162 of the fan area 160. The water loading is progressively decreased outwardly toward the perimeter walls of the cooling tower cell 150 by using springs with progressively less spring tension. By way of example, spray nozzles 10*b* may use a spring with a spring tension that is about 10% greater that the spring tension of the spring of the spray nozzles 10*a* and thus form a water loading zone 164. Spray nozzle 10*c* may use a spring that has a spring tension that is about 20% greater than the spring tension of the spring of the spray nozzle 10*a* and thus form a water loading zone 166.

Outside the fan area 160, spray nozzles 10*d* may use a spring that has a spring tension that is about 70% greater than the spring tension of the spring of the spray nozzles 10*a* and thus form a water loading zone 168. Spray nozzles 10*e* may use a spring with a spring tension about 80% greater than the spring tension of the spring of the spray nozzles 10*a* and thus form a water loading zone 170. Finally, spray nozzles 10*f* may use a spring with a spring tension about 90% greater than the spring tension of the spring of the spray nozzles 10*a* and thus form a water loading zone 172 along the perimeter of the air flow passageway 159.

While an example of a water loading design has been illustrated, it will be appreciated that the number of spray nozzles in each water loading zone, the configuration of the water loading zones, as well as the spring tension of the springs 54 may be varied depending on numerous factors including the size and configuration of the cooling tower cell and the size of the fan.

While the spray nozzles 10, 210, and 410 of the present invention have been disclosed for use in a cooling tower, it will be understood that the spray nozzles 10, 210, and 410 of the present invention may also be used in any fluid distributing application including for example lawn sprinklers, fluid evaporation, pond aeration, and even for distributing fluid solids, such as grain.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A spray nozzle, comprising:

a nozzle body defining a first surface and a fluid passage;

a cap defining a second surface, the cap connected to the nozzle body such that the first surface of the nozzle body and the second surface of the cap are able to define an annular nozzle opening therebetween;

a turbine having a plurality of radially extending fins circumferentially positioned about the nozzle opening for directing the flow of fluid exiting the nozzle opening, the turbine being rotatable about the nozzle opening and the nozzle opening being free of any portion of the turbine; and a grinding member aligned with the fluid passage of the nozzle body and actuated in response to rotation of the turbine to grind debris contained within the flow of fluid.

2. The spray nozzle of claim 1 wherein the nozzle body has a plurality of fins circumferentially spaced and extending over the nozzle opening so as to contain debris and direct such debris into engagement with the grinder.

3. The spray nozzle of claim 1 wherein the grinding member is positioned in the cap, and where the spray nozzle further comprises:

a shaft having one end connected to the turbine and another end connected to the grinding member to cause rotation of the grinding member in response to rotation of the turbine, the shaft having a flow passage extending therethrough to permit fluid and debris to pass from the cap and bypass the nozzle opening.

4. The spray nozzle of claim 3 further comprising a diffuser positioned to intercept the flow of fluid and debris from the flow passage.

5. The spray nozzle of claim 4 wherein the diffuser is coupled to the turbine such that the diffuser is caused to rotate in response to rotation of the turbine.

6. The spray nozzle of claim 3 wherein the grinding member has a central opening in fluid communication with the flow passage of the shaft and wherein the grinding member has a funnel shaped surface for directing debris toward the central opening.

7. The spray nozzle of claim 3 wherein the grinding member has a central opening in fluid communication with the flow passage of the shaft and wherein the spray nozzle further comprises a stationary scraper bar positioned in the central opening of the grinding member to dislodge debris from the central opening as the grinding member and the shaft rotate.

8. The spray nozzle of claim 1 further comprising:

a second grinding member connected to the turbine at a location that allows the flow of fluid exiting the nozzle opening and any debris contained therein to engage the grinding member.

9. The spray nozzle of claim 1 further comprising:

means for resiliently biasing the second surface into engagement with at least a portion of the first surface when the annular nozzle opening is in an un-pressurized condition and for allowing spacing between the first and second surfaces to increase in response to an increase in fluid pressure in the annular nozzle opening.

10. The spray nozzle of claim 1 wherein the grinding member is connected to the cap, and wherein the cap has at least one arm extending radially outwardly so as to be engageable with a portion of the turbine to cause rotation of the cap and the grinding member in response to rotation of the turbine.

11. The spray nozzle of claim 10 wherein the arm of the cap has an upper edge angle downwardly.

12. The spray nozzle of claim 10 wherein the arm is tapered toward a distal end.

13. The spray nozzle of claim 10 wherein the arm is disengageable from the turbine to facilitate debris traveling past the turbine and off the arm.

14. The spray nozzle of claim 1 wherein the turbine has a mounting ring from which the radially extending fins extend, the mounting ring positioned about and supported by the nozzle body to permit the turbine to rotate about the nozzle body.

15. The spray nozzle of claim 14 wherein nozzle body has a flange and wherein the turbine is secured to the nozzle body so that the mounting ring may be spaced a distance from the flange by the migration of fluid between the flange and the mounting ring to create a fluid bearing to facilitate rotation of the turbine.

16. A spray nozzle, comprising:

a nozzle body defining a first surface and a fluid passage;

a cap defining a second surface, the cap connected to the nozzle body such that the first surface of the nozzle body and the second surface of the cap are able to define an annular nozzle opening therebetween;

a turbine having a plurality of radially extending fins circumferentially positioned about the nozzle opening for directing the flow of fluid exiting the nozzle opening, the turbine being rotatable about the nozzle opening and the nozzle opening being free of any portion of the turbine, wherein the nozzle body has a plurality of guide posts extending from the first surface, each of the guide posts slidably extending through the cap, the cap being biased toward the nozzle body to allow the spacing between the first and second surfaces to increase in response to an increase in fluid pressure in the nozzle opening.

17. A spray nozzle, comprising:

a nozzle body defining a first surface and a fluid passage;

a cap defining a second surface, the cap connected to the nozzle body such that the first surface of the nozzle body and the second surface of the cap are able to define an annular nozzle opening therebetween;

a turbine having a plurality of radially extending fins circumferentially positioned about the nozzle opening for directing the flow of fluid exiting the nozzle opening; and a grinding member aligned with the fluid passage of the nozzle body and actuated in response to rotation of the turbine to grind debris contained within the flow of fluid.

18. The spray nozzle of claim 17 wherein the nozzle body has a plurality of fins circumferentially spaced and extending over the nozzle opening so as to contain debris and direct such debris into engagement with the grinder.

19. The spray nozzle of claim 17 wherein the grinding member is positioned in the cap, and wherein the spray nozzle further comprises:

a shaft having one end connected to the turbine and another end connected to the grinding member to cause rotation of the grinding member in response to rotation of the turbine, the shaft having a flow passage extending therethrough to permit fluid and debris to pass from the cap and bypass the nozzle opening.

20. The spray nozzle of claim 19 further comprising a diffuser positioned to intercept the flow of fluid and debris from the flow passage.

21. The spray nozzle of claim 20 wherein the diffuser coupled to the turbine such that the diffuser is caused to rotate with rotation of the turbine.

22. The spray nozzle of claim 19 wherein the grinding member has a central opening in fluid communication with the flow passage of the shaft and wherein the grinding member has a funnel shaped surface for directing debris toward the central opening.

23. The spray nozzle of claim 19 wherein the grinding member has a central opening in fluid communication with the flow passage of the shaft and wherein the spray nozzle further comprises a stationary scraper bar positioned in the central opening of the grinding member to dislodge debris from the central opening as the grinding member and the shaft rotate.

24. The spray nozzle of claim 17 further comprising:

a second grinding member connected to the turbine at a location that allows the flow of fluid exiting the nozzle opening and any debris contained therein to engage the grinder member.

25. The spray nozzle of claim 17 wherein the nozzle body has a plurality of guide posts extending from the first surface, each of the guide posts slidably extending through the cap, the cap being biased toward the nozzle body to allow the spacing between the first and second surfaces to increase in response to an increase in fluid pressure in the nozzle opening.

26. The spray nozzle of claim 17 further comprising:

means for resiliently biasing the second surface into engagement with at least a portion of the first surface when the annular nozzle opening is in an un-pressurized condition and for allowing the spacing between the first and second surfaces to increase in response to an increase in fluid pressure in the annular nozzle opening.

27. The spray nozzle of claim 17 wherein the grinding member is connected to the cap, and wherein the cap has at least one arm extending radially outwardly so as to be engageable with a portion of the turbine to cause rotation of the cap and the grinding member in response to rotation of the turbine.

28. The spray nozzle of claim 27 wherein the arm of the cap has an upper edge angle downwardly.

29. The spray nozzle of claim 27 wherein the arm is tapered toward a distal end.

30. The spray nozzle of claim 27 wherein the arm is disengageable from the turbine to facilitate debris traveling past the turbine and off the arm.

31. The spray nozzle of claim 17 wherein the turbine has a mounting ring from which the radially extending fins extend, the mounting ring positioned about and supported by the nozzle body to permit the turbine to rotate about the nozzle body.

32. The spray nozzle of claim 31 wherein the nozzle body has a flange and wherein the turbine is secured to the nozzle body so that the mounting ring may be spaced a distance from the flange by the migration of fluid between the flange and the mounting ring to create a fluid bearing to facilitate rotation of the turbine.

* * * * *